US005758704A

United States Patent [19]

Elrod

[11] Patent Number: 5,758,704

[45] Date of Patent: Jun. 2, 1998

[54] ROLL-UP SCREEN DOOR APPARATUS

[76] Inventor: Cynthia Kelly Elrod, 1422 14th St. East, Bradenton, Fla. 34208

[21] Appl. No.: 678,238

[22] Filed: Jul. 11, 1996

[51] Int. Cl.[6] ..... A47H 1/00

[52] U.S. Cl. ..... 160/98; 160/327

[58] Field of Search ..... 160/327, 354, 160/368.1, 330, 98

[56] References Cited

U.S. PATENT DOCUMENTS

| | | | |
|---|---|---|---|
| D. 360,472 | 7/1995 | Cooper . | |
| 948,433 | 2/1910 | Schofield | 160/328 |
| 1,110,857 | 9/1914 | Applas | 160/330 |
| 1,123,136 | 12/1914 | Northrop | 160/327 |
| 1,972,539 | 9/1934 | Simpson | 160/328 X |
| 2,886,481 | 5/1959 | Swan | 160/328 X |
| 3,004,592 | 10/1961 | Norton | 160/368.1 X |
| 3,321,003 | 5/1967 | Boerner | 160/330 X |
| 3,455,366 | 7/1969 | Bogumil | 160/368.1 |
| 3,638,711 | 2/1972 | Mazzarelle | 160/330 |
| 4,651,797 | 3/1987 | Lange . | |
| 4,874,028 | 10/1989 | Lynch et al. . | |
| 5,048,587 | 9/1991 | York . | |
| 5,323,835 | 6/1994 | Bachmeier . | |
| 5,358,025 | 10/1994 | Wood | 160/368.1 |
| 5,407,178 | 4/1995 | Long | 160/354 X |
| 5,427,169 | 6/1995 | Saulters . | |

*Primary Examiner*—David M. Purol

[57] ABSTRACT

A roll-up screen door apparatus, which is installed between a first door frame member and a second door frame member across a door threshold, includes a roll-up screen assembly which includes a first longitudinal rod, a second longitudinal rod, and a flexible screen connected between the two longitudinal rods. First frame connectors are connected to the first door frame member, and first screen assembly fasteners connect the roll-up screen assembly to the first frame connectors. Second frame connectors are connected to the second door frame member, and second screen assembly fasteners connect the roll-up screen assembly to the second frame connectors. The first frame connectors and the second frame connectors can be threaded eye fasteners which screw into the first door frame member and the second door frame member, respectively. The first screen assembly fasteners and the second screen assembly fasteners can be hook fasteners. A plurality of the hook fasteners are connected at a screen-connected end to the first screen end of the flexible screen, and a plurality of the hook fasteners are connected at a screen-connected end to the second screen end of the flexible screen. The hook fasteners also include first hook ends. The screen-connected ends of the hook fasteners include second hook ends, and the flexible screen includes rigid rings for receiving the second hook ends.

2 Claims, 3 Drawing Sheets

FIG 5
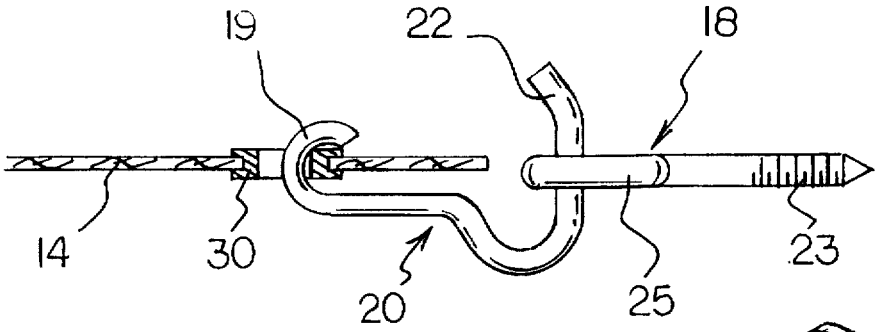
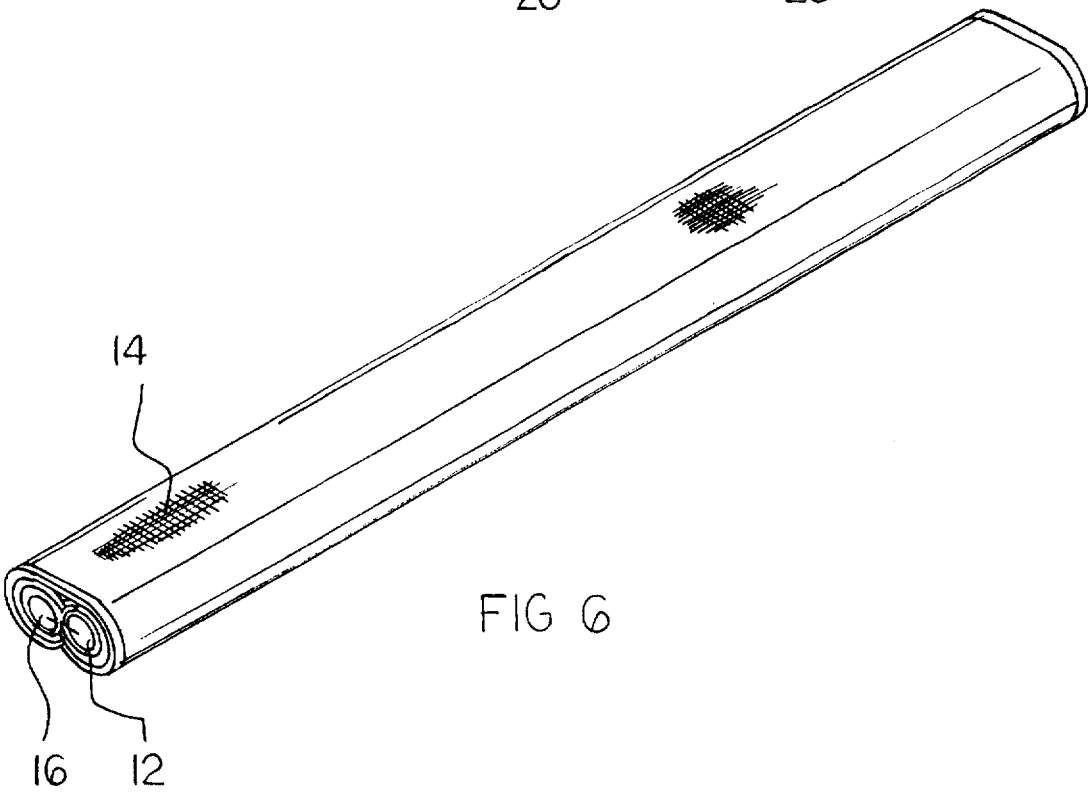
FIG 6

ROLL-UP SCREEN DOOR APPARATUS

BACKGROUND OF THE INVENTION

1. Field of the Invention

The present invention relates generally to screen devices and, more particularly, to screen devices especially adapted for providing a screen for a doorway.

2. Description of the Prior Art

The use of permanently installed screen doors is common in many places. However, there are also many places where permanently installed screen doors are not provided. Often, apartments and condominiums are not provided with permanently installed screen doors, and often restrictions against an individual installing a permanently installed screen door are imposed. To avoid restrictions against installing permanently installed screen doors, the use of temporary screen doors is well known in the art. In this respect, throughout the years, a number of innovations have been developed relating to temporary screen doors, and the following U.S. patents are representative of some of those innovations: U.S. Pat. Nos. 4,651,797, 4,874,028, 5,048,587, 5,323,835, and 5,427,169. More specifically, U.S. Pat. No. 4,651,797 discloses a roll-up screen door which employs a spring-biased roll upon which a large sheet of flexible screen material is initially wound. The flexible screen material is unwound from the roll against the tension of the spring bias. The need to overcome spring tension each time a roll-up screen door is installed may be an undesirable chore for many persons, particularly children and the elderly. In this respect, it would be desirable if a roll-up screen door were provided which does not include a roller spring whose spring bias must be overcome in order to install the roll-up screen door.

U.S. Pat. No. 4,874,028 discloses a temporary screen door devices that employs a spring tension support that is installed between vertical door jambs for a doorway. It may take considerable hand strength to overcome the tension in the spring tension support in order to install the spring tension support between the vertical door jambs. Such strength may not be available to certain persons, such as children and the elderly. In this respect, it would be desirable if a temporary screen door were provided which does not employ a spring tension support that is installed between two vertical door jambs.

U.S. Pat. No. 5,048,587 discloses a portable screen door insert which employs a rectangular frame for each screen portion. Rectangular frames take up quite a bit of surface area, and they may be readily susceptible to deformation and destruction. In this respect, it would be desirable if a portable screen door were provided which does not include rectangular frames for screen portions.

U.S. Pat. No. 5,323,835 discloses a removable screen for a car garage door. Strips of hook and loop material are required for installing the screen on the door frame. When using hook and loop material, it may be difficult to align the hook portion with the loop portion, especially when it is night time or during other low light level conditions. In this respect, it would be desirable if a roll-up screen door were provided which does not require the use hook and loop material for installing the screen on the door frame.

U.S. Pat. No. 5,427,169 discloses a flexible garage door screen which is suspended from a top, transverse, overhead portion of the garage door frame. Because many persons are not tall enough to reach up above a door frame to grasp a screen suspended from a top, transverse, overhead portion of the door frame, it would be desirable if a roll-up screen door were provided which is not suspended from a top, transverse, overhead portion of a door frame. In addition, U.S. Pat. No. Des. 360,472 may be of interest for its disclosure of a screen door.

Thus, while the foregoing body of prior art indicates it to be well known to use roll-up screen doors, the prior art described above does not teach or suggest a roll-up screen door apparatus which has the following combination of desirable features: (1) does not include a roller spring whose spring bias must be overcome in order to install the roll-up screen door; (2) does not employ a spring tension support that is installed between two vertical door jambs; (3) does not include rectangular frames for screen portions; (4) does not require the use of hook and loop material for installing the screen on a door frame; and (5) is not suspended from a top, transverse, overhead portion of a door frame. The foregoing desired characteristics are provided by the unique roll-up screen door apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a roll-up screen door apparatus, which is installed between a first door frame member and a second door frame member across a door threshold. The roll-up screen door apparatus includes a roll-up screen assembly which includes a first longitudinal rod, a flexible screen, and a second longitudinal rod. A first screen end of the flexible screen is connected to the first longitudinal rod, and the second longitudinal rod is connected to a second screen end of the flexible screen. First frame connectors are connected to the first door frame member, and first screen assembly fasteners connect the roll-up screen assembly to the first frame connectors. Second frame connectors are connected to the second door frame member, and second screen assembly fasteners connect the roll-up screen assembly to the second frame connectors.

The first frame connectors and the second frame connectors can be threaded eye fasteners which screw into the first door frame member and the second door frame member, respectively. The first screen assembly fasteners and the second screen assembly fasteners can be hook fasteners. A plurality of the hook fasteners are connected at a screen-connected end to the first screen end of the flexible screen, and a plurality of the hook fasteners are connected at a screen-connected end to the second screen end of the flexible screen. The hook fasteners also include first hook ends. The screen-connected ends of the hook fasteners include second hook ends, and the flexible screen includes rigid rings for receiving the second hook ends.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved roll-up screen door apparatus which has all of the advantages of the prior art and none of the disadvantages.

It is another object of the present invention to provide a new and improved roll-up screen door apparatus which may be easily and efficiently manufactured and marketed.

It is a further object of the present invention to provide a new and improved roll-up screen door apparatus which is of durable and reliable construction.

An even further object of the present invention is to provide a new and improved roll-up screen door apparatus which is susceptible of a low cost of manufacture with regard to both materials and labor, and which accordingly is then susceptible of low prices of sale to the consuming public, thereby making such roll-up screen door apparatus available to the buying public.

Still yet a further object of the present invention is to provide a new and improved roll-up screen door apparatus which does not include a roller spring whose spring bias must be overcome in order to install the roll-up screen door.

Still another object of the present invention is to provide a new and improved roll-up screen door apparatus that does not employ a spring tension support that is installed between two vertical door jambs.

Yet another object of the present invention is to provide a new and improved roll-up screen door apparatus which does not include rectangular frames for screen portions.

Even another object of the present invention is to provide a new and improved roll-up screen door apparatus that does not require the use of hook and loop material for installing the screen on a door frame.

Still a further object of the present invention is to provide a new and improved roll-up screen door apparatus which is not suspended from a top, transverse, overhead portion of a door frame.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is an enlarged cross-sectional view the portion of the embodiment of the invention shown in FIG. 3 taken along line 5—5 thereof.

FIG. 6 is a perspective view of the embodiment of the invention shown in FIG. 2 removed from the door frame and in a rolled-up or storage condition.

DESCRIPTION OF THE PREFERRED EMBODIMENT

Figure 1:
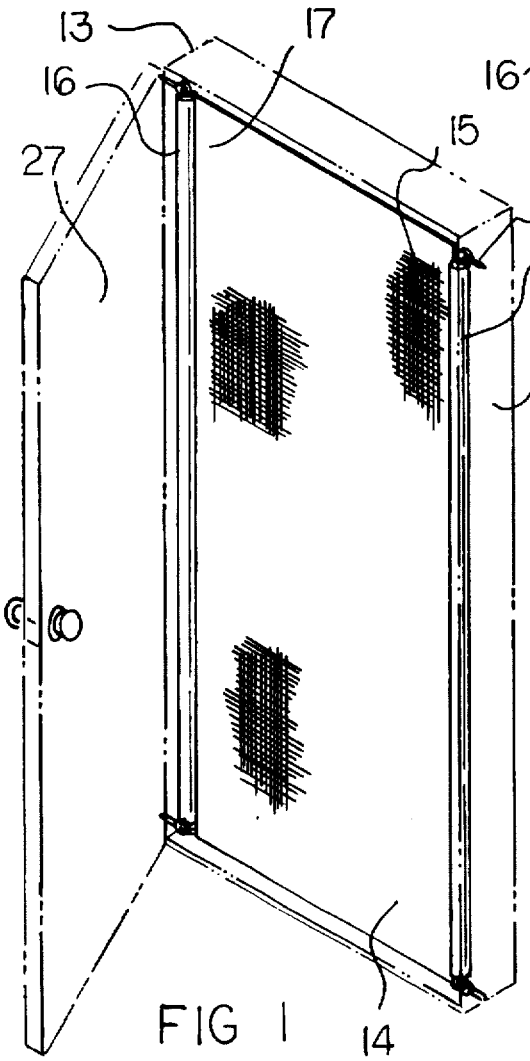
FIG. 1 is a perspective view showing a preferred embodiment of the roll-up screen door apparatus of the invention installed on vertical portions of a door frame and extending across the door threshold.

With reference to the drawings, a new and improved roll-up screen door apparatus embodying the principles and concepts of the present invention will be described.

Turning to FIGS. 1–6, there is shown an exemplary embodiment of the roll-up screen door apparatus of the invention generally designated by reference numeral 10. In its preferred form, a roll-up screen door apparatus 10 is installed between a first door frame member 11 and a second door frame member 13 across a door threshold. The roll-up screen door apparatus 10 includes a roll-up screen assembly which includes a first longitudinal rod 12, a flexible screen 14, and a second longitudinal rod 16. A first screen end 15 of the flexible screen 14 is connected to the first longitudinal rod 12, and the second longitudinal rod 16 is connected to a second screen end 17 of the flexible screen 14. First frame connectors are connected to the first door frame member 11, and first screen assembly fasteners connect the roll-up screen assembly to the first frame connectors. Second frame connectors are connected to the second door frame member 13, and second screen assembly fasteners connect the roll-up screen assembly to the second frame connectors.

The first frame connectors and the second frame connectors can be threaded eye fasteners 18 which screw into the first door frame member 11 and the second door frame member 13, respectively. The first screen assembly fasteners and the second screen assembly fasteners can be hook fasteners 20. A plurality of the hook fasteners 20 are connected at a screen-connected end to the first screen end 15 of the flexible screen 14, and a plurality of the hook fasteners 20 are connected at a screen-connected end to the second screen end 17 of the flexible screen 14. The hook fasteners 20 also include first hook ends 22. The screen-connected ends of the hook fasteners 20 include second hook ends 19, and the flexible screen 14 includes rigid rings 30 for receiving the second hook ends 19.

Figure 2:
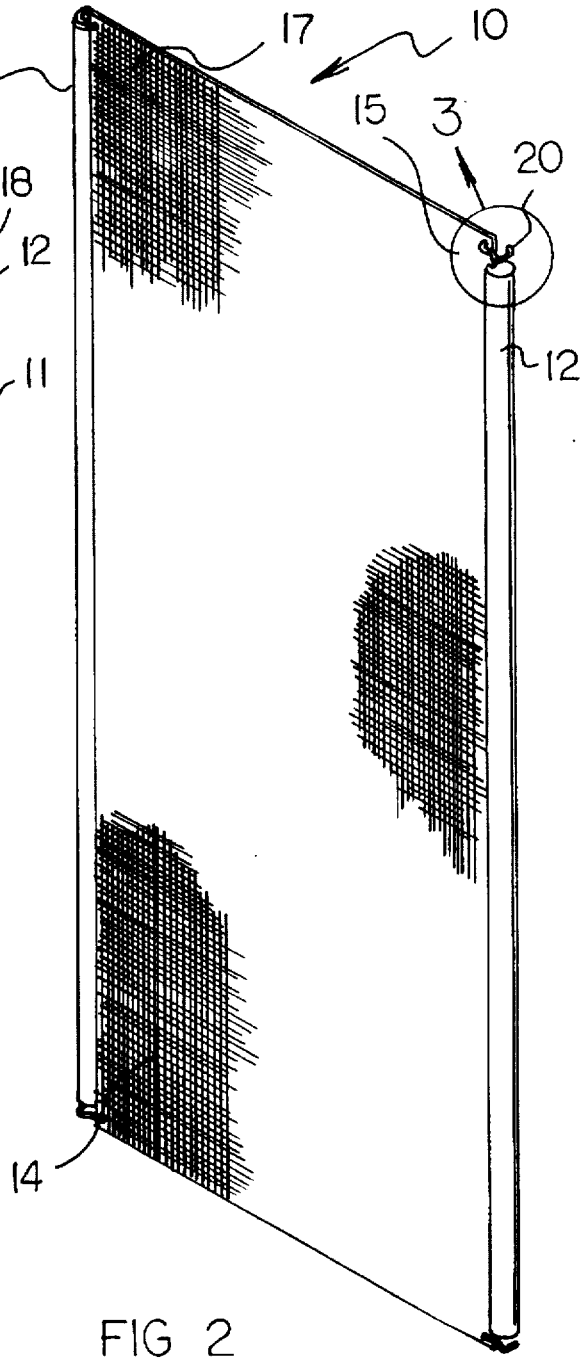
FIG. 2 is an enlarged perspective view of the embodiment of the roll-up screen door apparatus shown in FIG. 1 removed from the door frame and in an extended or unrolled condition.
Figure 3:
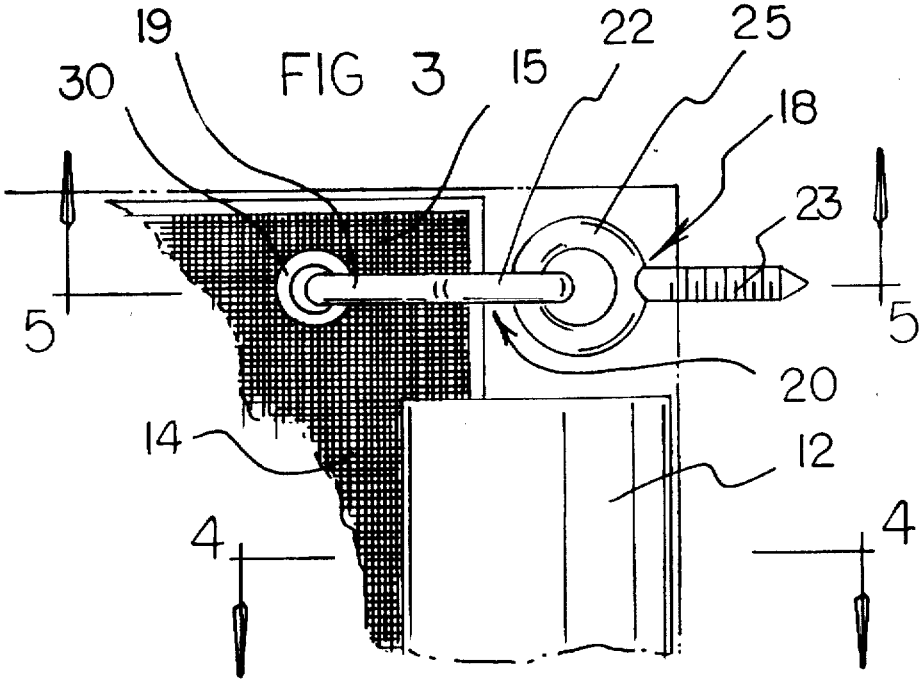
FIG. 3 is an enlarged from view of a portion of the embodiment of the invention shown in FIG. 2 that is contained with circled area 3 of FIG. 2.
Figure 4:
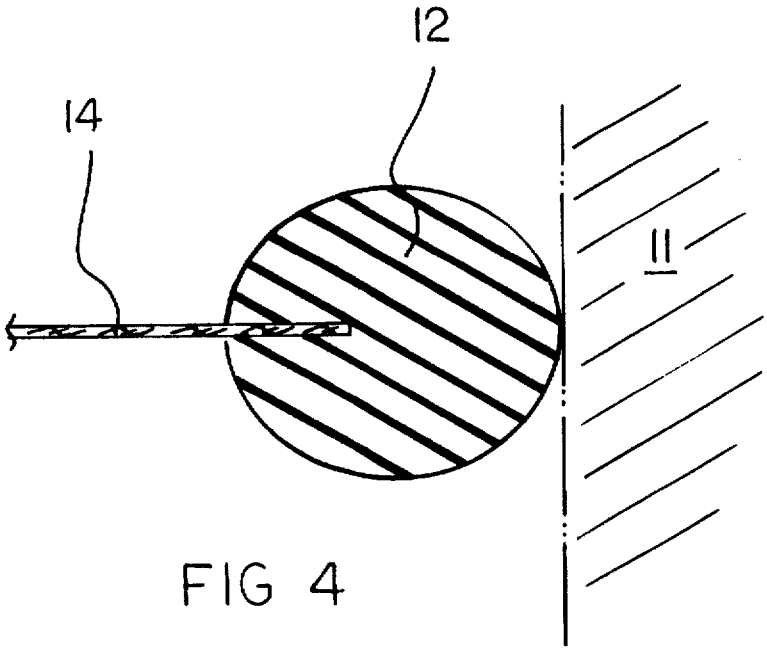
FIG. 4 is a cross-sectional view of the portion of the embodiment of the invention shown in FIG. 3 taken along line 4—4 thereof.

As shown in FIG. 1, an upper door frame member and a lower door frame member (not labeled) can extend between the upper ends and the lower ends, respectively, of the first and second door frame members 11 and 13. Preferably, and as shown in FIGS. 2 and 3, the first screen end 15 extends above an upper end of the first longitudinal rod 12, and the second screen end 17 extends above an upper end of the second longitudinal rod 16. This allows an upper portion of the flexible screen 14 extending between the longitudinal rods 12 and 16 and above the upper ends of the longitudinal rods to extend into a parallel and adjacent orientation to the upper door frame member. Further the first screen end 15 extends below a lower end of the first longitudinal rod 12, and the second screen end 17 extends below a lower end of the second longitudinal rod 16. Similarly, this allows a lower portion of the flexible screen 14 extending between the longitudinal rods 12 and 16 and below the lower ends of the longitudinal rods to extend into a parallel and adjacent orientation to the lower door frame member.

As shown in FIG. 1, the first and second door frame members 11 and 13 have interior surfaces facing each other. Similarly, the upper and lower door frame members have interior surfaces faces one another. Preferably, the flexible screen is positioned completely within the door frame members between the interior surfaces thereof, as shown in FIG. 1.

In using the roll-up screen door apparatus 10 of the invention, the width of a door frame is measured, and the flexible screen 14 is cut so that the flexible screen 14 extends substantially across the width of the door frame threshold when the roll-up screen door apparatus 10 is in a threshold screening mode such as shown in FIGS. 1 and 2. In FIG. 1, a door 27 is in an open condition, whereby the threshold is open. The threaded ends 23 of some of the threaded eye fasteners 18 are driven into the first door frame member 11, and the threaded ends 23 of other of the threaded eye fasteners 18 are driven into the second door frame member 13. The threaded eye fasteners 18 are positioned on the first door frame member 11 and the second door frame member 13 so that the first hook ends 22 of the hook fasteners 20, which are attached to the flexible screen 14, are in registration with the eye portions 25 of the threaded eye fasteners 18 when the roll-up screen door apparatus 10 is in the screening mode. More specifically, to attach the roll-up screen assembly to the threaded eye fasteners 18, the first hook ends 22 of the hook fasteners 20 are placed through the eye portions 25 of the threaded eye fasteners 18, as shown in FIGS. 3 and 5.

To remove the roll-up screen assembly from the door frame, the first hook ends 22 of the hook fasteners 20 are disengaged from the eye portions 25 of the threaded eye fasteners 18. Once the roll-up screen assembly is removed from the door frame, portions of the flexible screen 14 can be rolled up on each of the first longitudinal rod 12 and the second longitudinal rod 16 in the manner of a scroll, such as shown in FIG. 6, which can be characterized as a storage mode.

The components of the roll-up screen door apparatus of the invention can be made from inexpensive and durable metal and plastic materials. Preferably, the flexible screen 14 is made from flexible plastic screen material.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved roll-up screen door apparatus that is low in cost, relatively simple in design and operation, and which may advantageously be used without employing a roller spring whose spring bias must be overcome in order to install the roll-up screen door. With the invention, a roll-up screen door apparatus is provided which does not employ a spring tension support that is installed between two vertical door jambs. With the invention, a roll-up screen door apparatus is provided which does not include rectangular frames for screen portions. With the invention, a roll-up screen door apparatus is provided which does not require the use of hook and loop material for installing the screen on a door frame. With the invention, a roll-up screen door apparatus is provided which is not suspended from a top, transverse, overhead portion of a door frame.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A roll-up screen door apparatus in combination with a first door frame member extending in a vertical orientation; a second door frame member extending in a vertical orientation and being spaced from the first door frame member a first distance; and a door pivotally connected to the second door frame member; said apparatus comprising:

a flexible screen including a first screen end and a second screen end, the screen ends being straight and parallel and being separated by the first distance, the screen ends having a longitudinal length substantially greater than the first distance;

a first longitudinal rod connected to and extending along the first screen end of the flexible screen, the first longitudinal rod being coupled adjacent to and extending in a parallel orientation with the first door frame member;

a second longitudinal rod connected to and extending along the second screen end of the flexible screen, the second longitudinal rod being removably coupled adjacent to and extending in a parallel orientation with the second door frame member, the first and second longitudinal rods supporting the flexible screen between the door frame members;

wherein the first longitudinal rod is adapted to be de-coupled from the first door frame member and pivoted about the second longitudinal rod in a parallel orientation relative thereto to allow for ease of access through the door, wherein an upper door frame member extends between upper end of the first and second door frame members, and a lower door frame member extends between lower ends of the first and second door frame members, and wherein the first screen end extends above an upper end of the first longitudinal rod, and the second screen end extends above an upper end of the second longitudinal rod, such that an upper portion of the flexible screen extends above the upper ends of the longitudinal rods, the upper portion of the flexible screen extending parallel and adjacent to the upper door frame member;

wherein the first screen end extends below a lower end of the first longitudinal rod, and the second screen end extends below a lower end of the second longitudinal rod, such that a lower portion of the flexible screen extends below the lower ends of the longitudinal rods, the lower portion of the flexible screen extending parallel and adjacent to the lower door frame member; said apparatus further including first removable coupling means connected between said upper portion of the flexible screen that extends above the upper ends of the longitudinal rods and the interior surfaces of the upper ends of said first and second door frame members, and second removable coupling means connected between said lower portion of the flexible screen that extends below the lower ends of the longitudinal rods and the interior surfaces of the lower ends of said first and second door frame members.

2. The roll-up screen door apparatus of claim 1, wherein the first and second door frame members have interior surfaces facing one another, and the upper and lower door frame members have interior surfaces facing one another, with all of the flexible screen being positioned completely within the door frame members between the interior surfaces thereof.

* * * * *